United States Patent [19]

Kania

[11] Patent Number: 4,651,686

[45] Date of Patent: Mar. 24, 1987

[54] HIGH-SPEED, PORT-CONTROLLED, TWO-STROKE INTERNAL COMBUSTION ENGINE WITH CRANKCASE SCAVENGING

[75] Inventor: Norbert Kania, Hanover, Fed. Rep. of Germany

[73] Assignee: Sachs-Systemtechnik GmbH, Schweinfurt, Fed. Rep. of Germany

[21] Appl. No.: 598,291

[22] PCT Filed: Sep. 7, 1983

[86] PCT No.: PCT/DE83/00157

§ 371 Date: Mar. 12, 1984

§ 102(e) Date: Mar. 12, 1984

[87] PCT Pub. No.: WO84/00995

PCT Pub. Date: Mar. 15, 1984

[30] Foreign Application Priority Data

Sep. 7, 1982 [DE] Fed. Rep. of Germany ..... 3233108

[51] Int. Cl.[4] ..... F02B 75/02

[52] U.S. Cl. ..... 123/65 P; 123/65 A

[58] Field of Search ..... 123/65 P, 65 A, 65 PE, 123/73 PP, 65 PD

[56] References Cited

U.S. PATENT DOCUMENTS 3,945,354 3/1976 Johnston ..... 123/65 P 4,337,734 7/1982 Iio ..... 123/65 PE 4,458,636 7/1984 Kania ..... 123/73 R

FOREIGN PATENT DOCUMENTS 748335 12/1944 Fed. Rep. of Germany .

1033461 12/1958 Fed. Rep. of Germany .

1177412 9/1964 Fed. Rep. of Germany .... 123/65 P 2624249 12/1976 Fed. Rep. of Germany .

3100851 8/1982 Fed. Rep. of Germany .

*Primary Examiner*—Craig R. Feinberg

*Assistant Examiner*—David A. Okonsky

*Attorney, Agent, or Firm*—Erwin S. Teltscher; Peter R. Ruzek

[57] ABSTRACT

In the case of a high-speed, port-controlled two-stroke internal combustion engine with crankcase scavenging with at least one cylinder having in each case at least one suction duct with an inlet port, with in each case at least one outlet duct with an outlet port and with at least one scavenging duct with a transfer port, the inlet, outlet and transfer ports being arranged on the cylinder inside, the geometrical construction of the suction duct (4) and/or outlet duct (6) is such that the engine noise is reduced throughout the speed range, while increasing the engine efficiency and while simultaneously improving the specific fuel consumption.

21 Claims, 41 Drawing Figures

Figure 1:
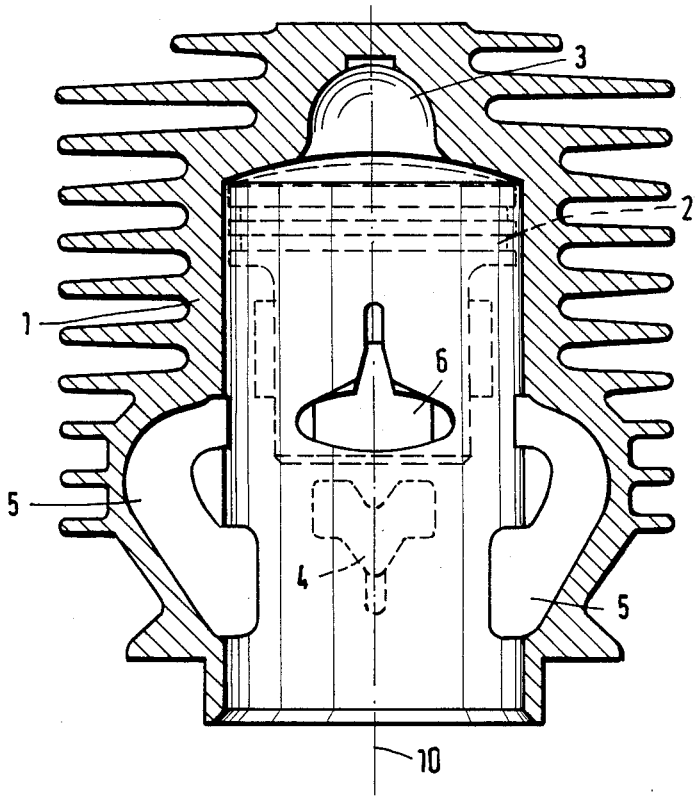

B
C
ZS
SE
GE
4
NE
VE
238a
238
238b
A
EG
132
130
133
131b
131a
M
ES
K
134b
134a
136
137
135a
135b
138b
138a
138c
RE
E
238

HIGH-SPEED, PORT-CONTROLLED, TWO-STROKE INTERNAL COMBUSTION ENGINE WITH CRANKCASE SCAVENGING

FIELD OF USE

The internal combustion engine according to the invention can be used whenever a high-speed, port-controlled, two-stroke internal combustion engine with crankcase scavenging is used as a high-performance motor, e.g. as a two-wheel drive, or as a choke motor, e.g. as a chain saw drive.

PRIOR ART

An internal combustion engine, particularly a high-speed, port-controlled, two-stroke internal combustion engine with crankcase scavenging is known from DAS No. 2,624,249.

Attempts have been made in connection with such an internal combustion engine to reduce the idling noise by modifying the outlet port geometry. Apart from the conventional outlet, additional auxiliary openings were provided and these and the outlet port were arranged in such a way that they satisfied given mathematical conditions. However, the known construction of the outlet port geometry for reducing noise has not proved satisfactory, because the greatest noise formation in the case of such two-stroke internal combustion engines occurs under full load and when idling, when the engine is operating at full speed, but without loading.

Attempts have also been made by using secondary measure to reduce the running noise of the engine. However, this led to disadvantageous effects on the performance or fuel consumption behaviour of the engines.

PROBLEMS, SOLUTION, ADVANTAGES

The present invention aims at providing a high-speed, port-controlled, two-stroke internal combustion engine in which, through a suitable construction of the inlet port geometry and/or outlet port geometry, it is ensured that the engine noise is reduced throughout its speed range, whilst maintaining the performance level and whilst simultaneously improving the specific fuel consumption.

Thus, to solve this problem, the invention provides a high-speed, port-controlled, two-stroke internal combustion engine with crankcase scavenging with at least one cylinder with in each case at least one suction duct with an inlet port, with in each case at least one outlet duct with an outlet port and with at least one scavenging duct with a transfer port, the inlet, outlet and transfer ports being located on the inside of the cylinder, characterized in that (a) the suction duct of the cylinder (a1) on the carburretor side mixed inflow side has a substantially rectangular cross-section with an upper port boundary at right angles to the cylinder longitudinal axis and a lower port boundary at right angles to the cylinder longitudinal axis, as well as lateral port boundaries approximately parallel to the cylinder longitudinal axis, the cross-section being increased over and beyond the lower port boundary in the vicinity of the vertical median plane, (a2) a suction port cross-sectional profile on the inside of the cylinder and comprising a pre-inlet part and a post-inlet part upwardly following onto the latter in the cylinder longitudinal direction and having in the vicinity of the post-inlet part a substantially rectangular cross-section with a generally V-shaped channel in the vicinity of the vertical median plane and with upper port boundaries at right angles to the cylinder longitudinal axis and with lower port boundaries at right angles to the cylinder longitudinal axis, as well as lateral port boundaries running approximately parallel to the cylinder longitudinal axis and with a cross-section in the form of a geometrical shape in the vicinity of the pre-inlet part, (a3) a cross-sectional profile emanating from the inflow cross-section in the flow direction and which remains constant in its horizontal extension or uniformly decreases and having a generally V-shaped channel uniformly growing in the flow direction and extending in the region of the vertical median plane, and (a4) a cross-sectional profile emanating from the inflow cross-section in the flow direction and which uniformly varies in its vertical extension, and/or that (b) the outlet duct of the cylinder (b1) on the silencer side exhaust gas outflow side has a substantially rectangular cross-section with an upper port boundary running at right angles to the cylinder longitudinal axis and a lower port boundary running at right angles to the cylinder longitudinal axis, as well as with lateral port boundaries running approximately parallel to the cylinder longitudinal axis, the cross-section being widened over and beyond the upper port boundary roughly in the vicinity of the horizontal median plane, (b2) an outlet port cross-sectional profile on the inside of the cylinder comprising a pre-inlet part and a post-inlet part following onto the bottom of the pre-outlet part in the cylinder longitudinal axis and having in the vicinity of the post-outlet part a substantially ellipsoidal cross-section with a pitch circle-shaped upper port boundary and with a pitch circle-shaped lower port boundary and with pitch circle-shaped or straight port boundaries and with a cross-section in the form of a geometrical shape in the region of the pre-outlet part, (b3) a cross-sectional profile emanating from the outlet cross-sectional profile in the flow direction and which remains constant in its horizontal extension, or which uniformly decreases, (b4) a cross-sectional profile emanating from the outlet cross-sectional profile in the flow direction and which varies in its vertical extension.

In the case of a high-speed, port-controlled, two-stroke internal combustion engine with crankcase scavenging constructed in this way, it is achieved as a result of the particular construction of the geometry of the inlet duct or outlet duct or the combination of such inlet and outlet ducts in the cylinder, that during the upward and downward movements of the piston in the cylinder as a result of a gradual opening of the particular suction and outlet ports, the noise-producing suction pipe and outlet pressure gradients and amplitudes are reduced. On the inlet side, there is an additional deflection for the propagating airborne sound directed counter to the inflow process until the actual suction pipe/carburettor connection cross-section is reached, which leads to a further noise reduction. Furthermore, and of particular importance with respect to the desired noise reduction of the working and operating noise of the internal combustion engine, on the outlet side where the propagation direction of the sound and/or pressure waves coincides with the direction of the outflowing exhaust gas, there is also an additional deflection until the actual bend-/silencer connection cross-section is reached. This additional deflection of the sound and/or pressure waves on the outlet side has an even more pronounced effect than on the inlet side due to the greater excitation in the pre-outlet phase, so that the noise reduction is of a considerable nature. Thus, through the new design of the geometry of the inlet port, together with that of the suction duct connected upstream of said inlet port, as well as the new construction design of the geometry of the outlet port, together with that of the downstream-connected outlet duct and particularly the combination thereof, leads to a considerable reduction in noise in the entire speed range of the port-controlled, two-stroke internal combustion engine, so that as a result of these measures on the primary side of noise production, the use of secondary measures is rendered superfluous.

DEVELOPMENT OF THE INVENTION

Further advantageous developments of the invention can be gathered from the subclaims.

Embodiments are described relative to the drawings, wherein show:

FIG. 1 a two-stroke cylinder with the suction and outlet ducts according to the invention in a vertical sectional view.

Figure 2:
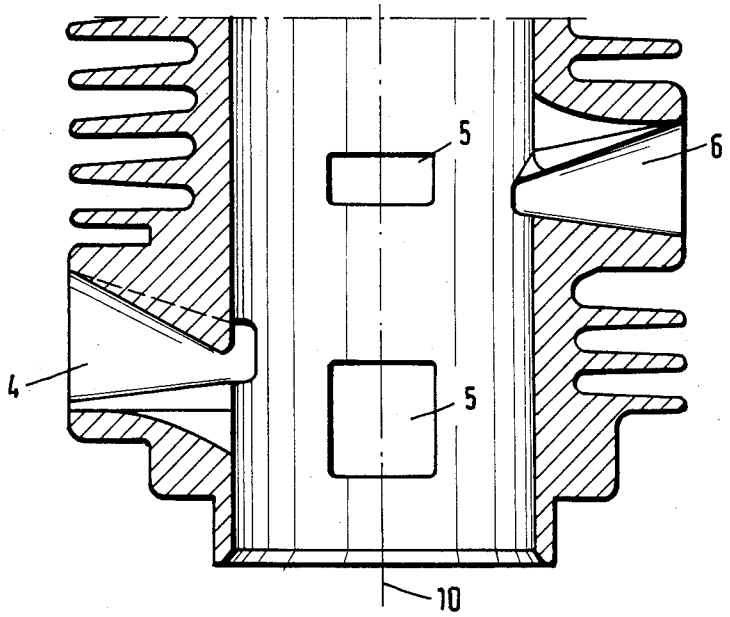

FIG. 2 a two-stroke cylinder in a partial view in a vertical sectional representation turned by 90° compared with FIG. 1.

Figure 3A:
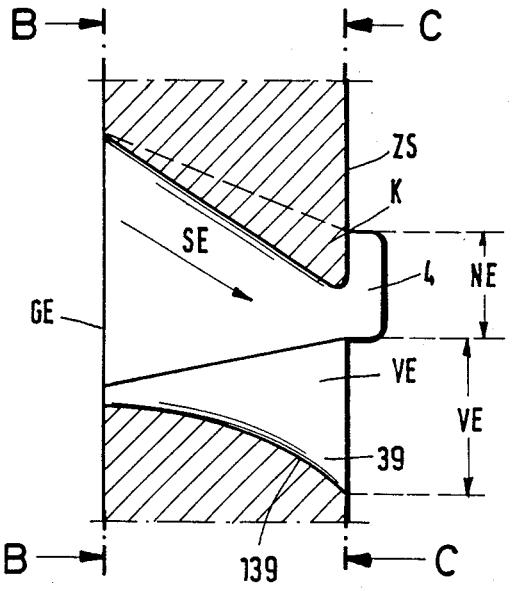

FIG. 3*a* the suction duct of the cylinder according to FIG. 1 in a side view in vertical sectional form.

Figure 3B:
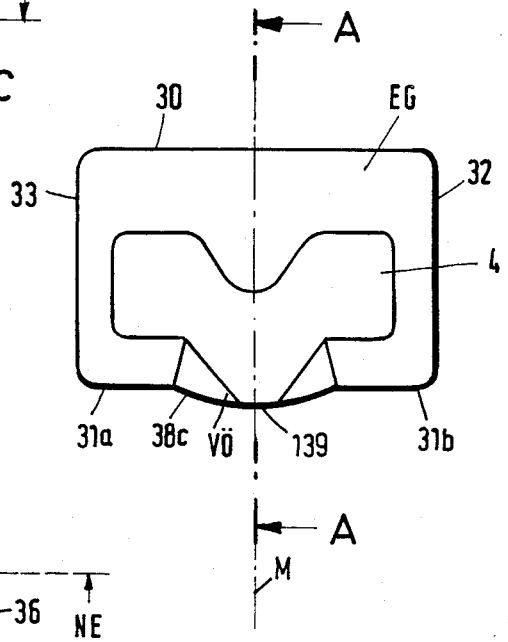

FIG. 3*b* the suction duct of FIG. 3*a* in a view of the cylinder inside in cutaway form.

Figure 3C:
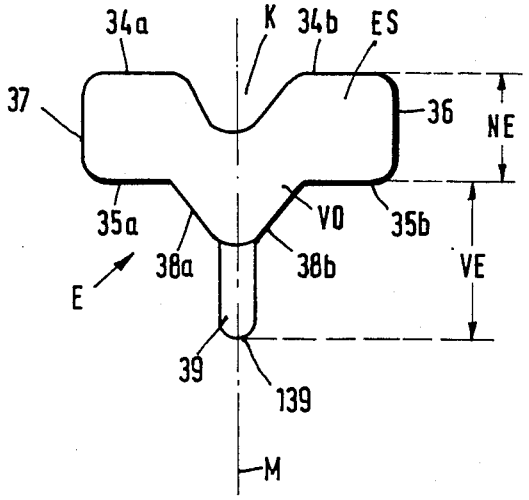

FIG. 3*c* the suction duct according to FIG. 3*a* in a view of the cylinder outside in cutaway form.

Figure 4A:
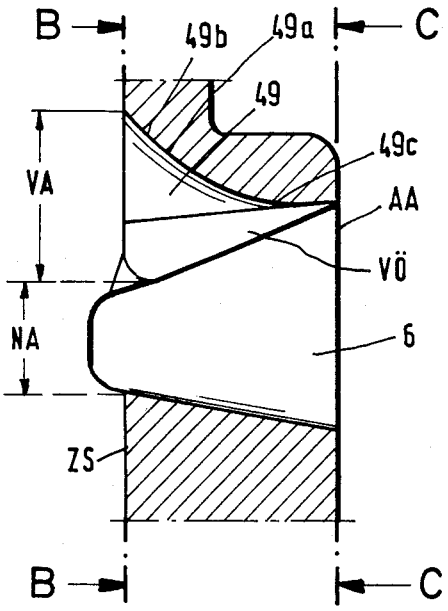

FIG. 4*a* the outlet duct of the cylinder according to FIG. 1 in a side view in vertical sectional representation.

Figure 4B:
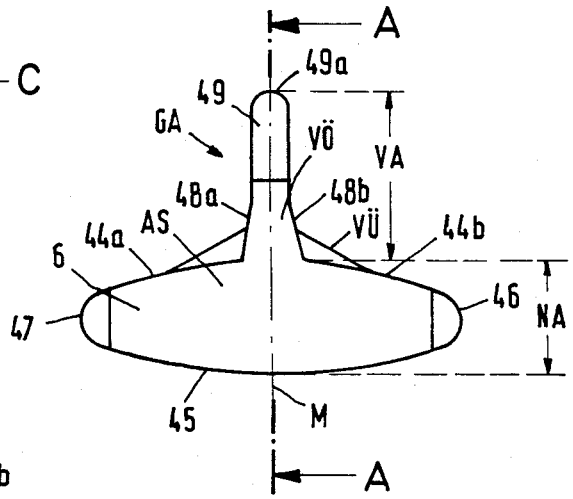

FIG. 4*b* the outlet duct according to FIG. 4*a* in a view of the cylinder outside in cutaway form.

Figure 4C:
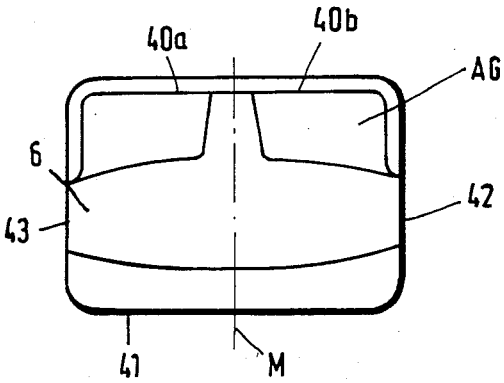

FIG. 4*c* the outlet duct according to FIG. 4*a* in a view of the cylinder outside in cutaway form.

Figures 5A, 5B, 5C:
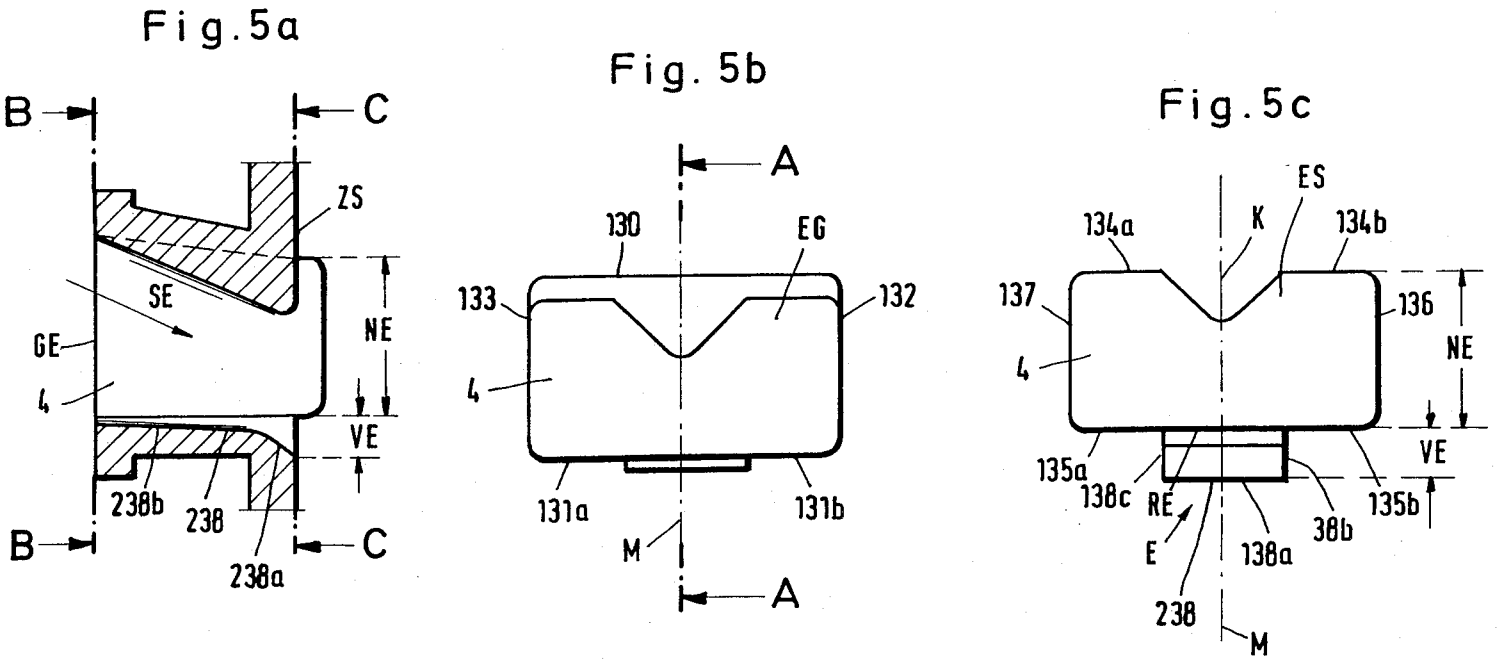

FIG. 5*a* another embodiment of a suction duct of the cylinder in side view and vertical sectional form.

FIG. 5*b* the suction duct of FIG. 5*a* in a view of the cylinder inside in cutaway form.

FIG. 5*c* the suction duct of FIG. 5*a* in a view of the cylinder outside in cutaway form.

Figure 6A:
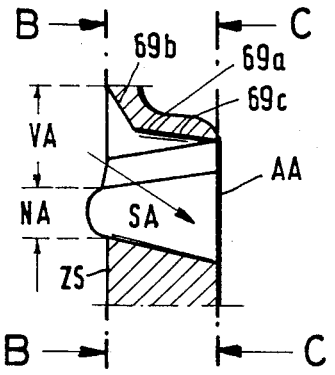

FIG. 6*a* a further embodiment of the outlet duct of the cylinder in side view in vertical sectional form.

Figure 6B:
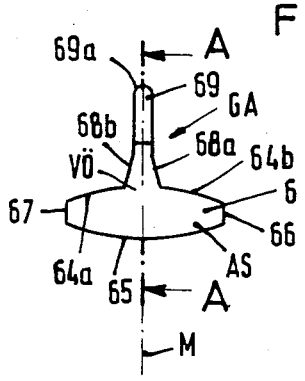

FIG. 6*b* the outlet duct according to FIG. 6*a* in a view of the cylinder inside in cutaway form.

Figure 6C:
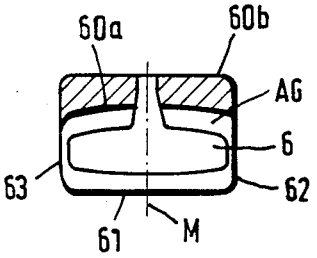

FIG 6*c* the outlet duct of FIG. 6*a* in a view of the cylinder outside in a cutaway form.

Figure 7A:
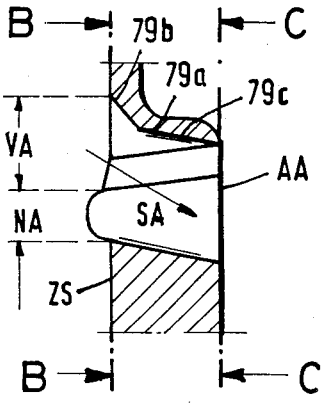
Figure 7B:
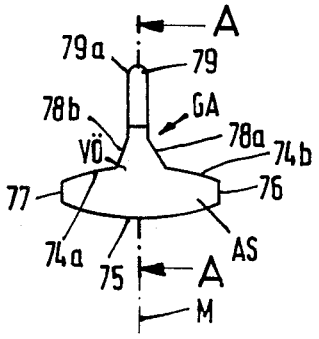
Figure 7C:
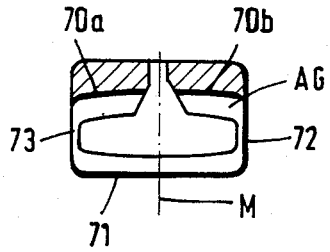

FIGS. 7*a* to 7*c* a further embodiment of the cylinder outlet duct in side view in vertical sectional representation, in a view of the cylinder inside and a view of the cylinder outside in cutaway forms.

Figure 8A:
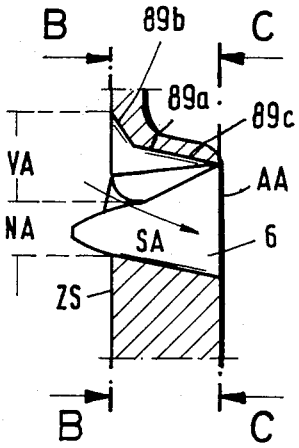
Figure 8B:
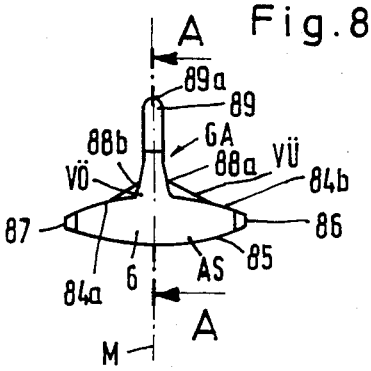
Figure 8C:
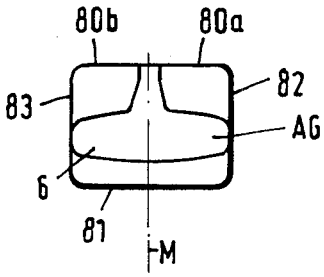

FIGS. 8*a* to 8*c* a further embodiment of the cylinder outlet duct in side view in vertical sectional representation, in a view of the cylinder inside and a view of the cylinder outside in cutaway forms.

Figure 9A:
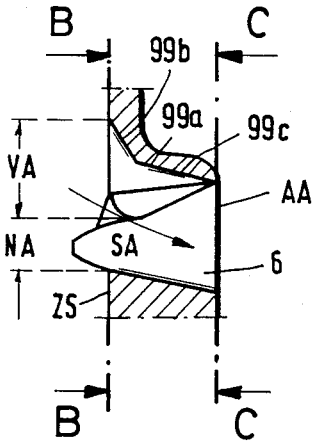
Figure 9B:
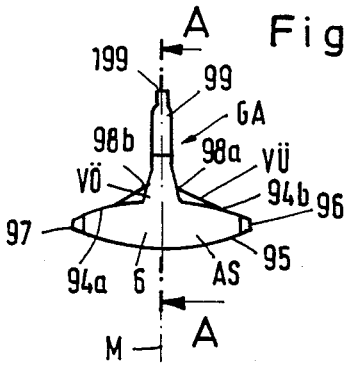
Figure 9C:
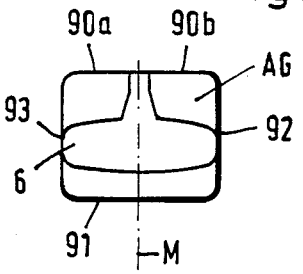

FIGS. 9*a* to 9*c* a further embodiment of the cylinder outlet duct in side view in vertical sectional representation, in a view of the cylinder inside and a view of the cylinder outside in cutaway forms.

Figure 10A:
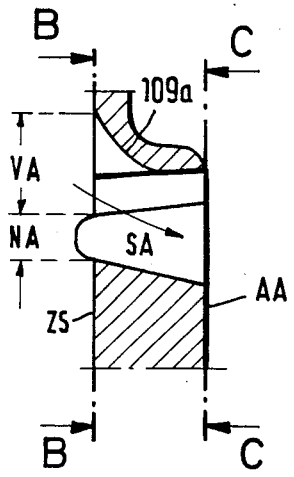
Figure 10B:
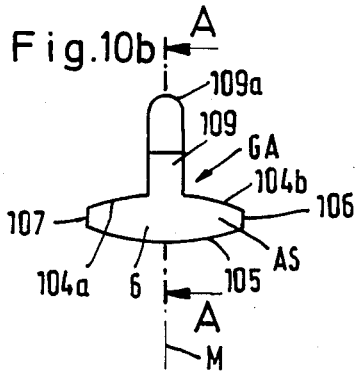
Figure 10C:
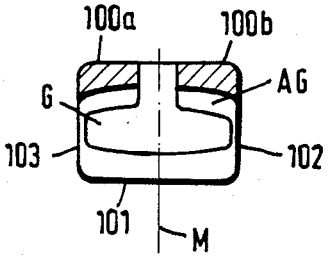

FIGS. 10*a* to 10*c* a further embodiment of the cylinder outlet duct in side view in vertical sectional representation, in a view of the cylinder inside and a view of the cylinder outside in cutaway forms.

Figure 11A:
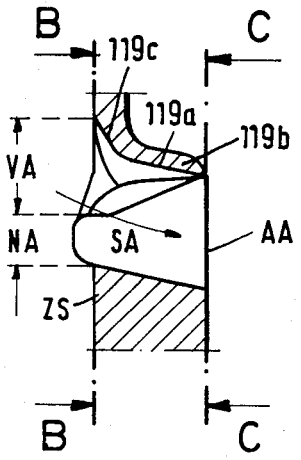
Figure 11B:
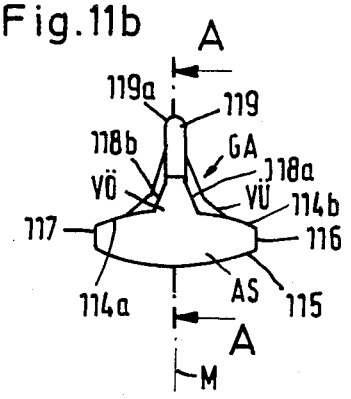
Figure 11C:
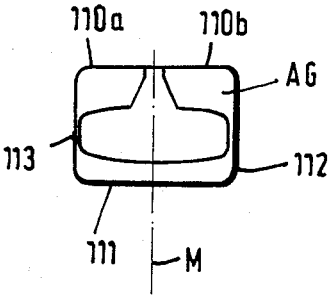

FIGS. 11*a* to 11*c* a further embodiment of the cylinder outlet duct in side view in vertical sectional representation, in a view of the cylinder inside and a view of the cylinder outside in cutaway forms.

Figure 12A:
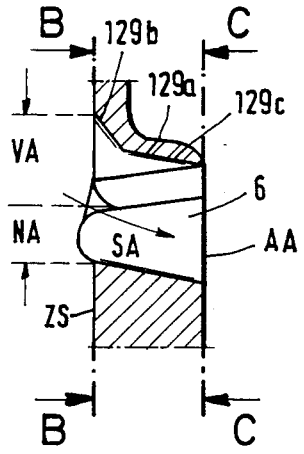
Figure 12B:
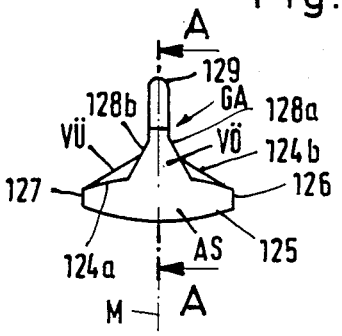
Figure 12C:
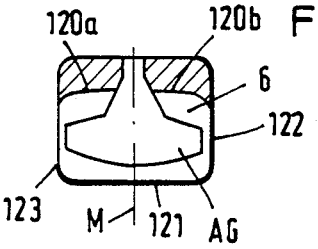

FIGS. 12*a* to 12*c* a further embodiment of the cylinder outlet duct in side view in vertical sectional representation, in a view of the cylinder inside and a view of the cylinder outside in cutaway forms.

Figure 13A:
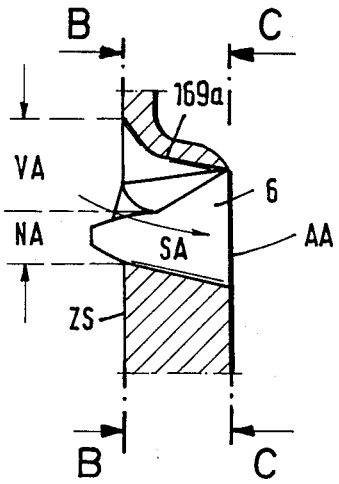
Figure 13B:
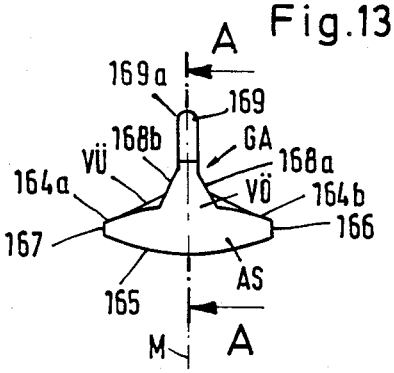
Figure 13C:
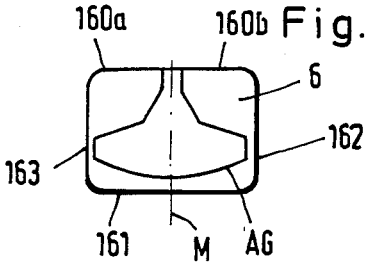

FIGS. 13*a* to 13*c* a further embodiment of the cylinder outlet duct in side view in vertical sectional representation, in a view of the cylinder inside and a view of the cylinder outside in cutaway forms.

Figure 14A:
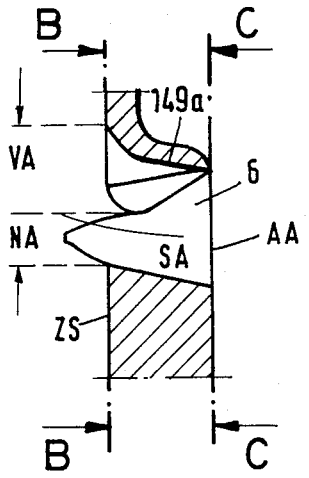
Figure 14B:
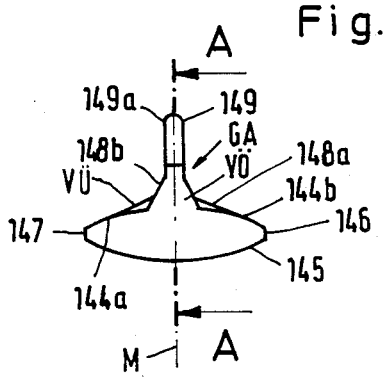
Figure 14C:
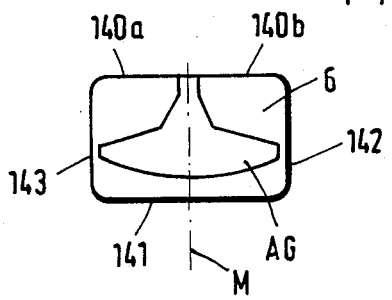

FIGS. 14*a* to 14*c* a further embodiment of the cylinder outlet duct in side view in vertical sectional representation, in a view of the cylinder inside and a view of the cylinder outside in cutaway forms.

Figure 15A:
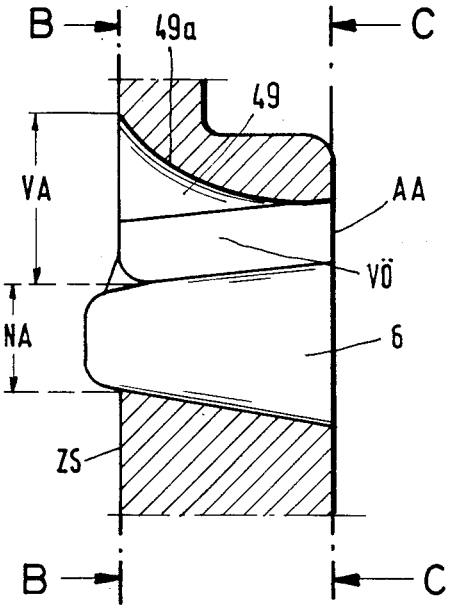
Figure 15B:
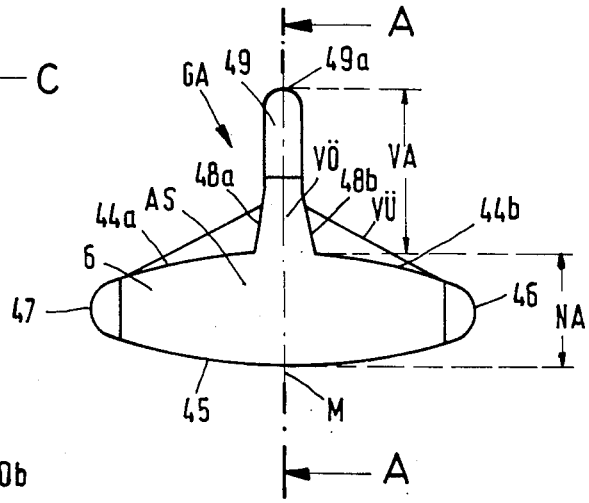
Figure 15C:
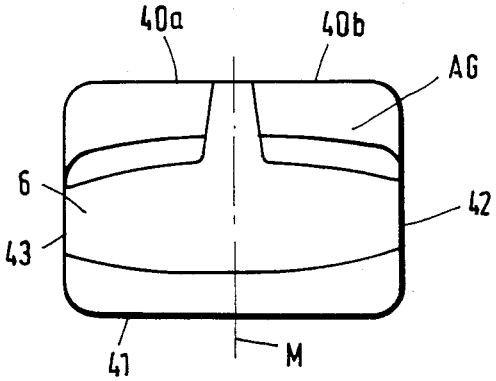

FIGS. 15*a* to 15*c* a further embodiment of the cylinder outlet duct in side view in vertical sectional representation, in a view of the cylinder inside and a view of the cylinder outside in cutaway forms.

BEST WAY FOR REALISING THE INVENTION

FIGS. 1 and 2 show in longitudinal sectional form a two-stroke internal combustion engine cylinder, which is normally mounted on the top of a crankcase. The suction and outlet ports are placed in one sectional plane to make clear the associated port configuration, the suction port of suction duct 4 placed in the drawing plane only being shown in broken line form. Piston 2, shown in broken line form, works within cylinder 1 and during its upward and downward stroke passes over the suction port of suction duct 4, the outlet port of outlet duct 6 and the transfer ports of scavenging ducts 5. 3 is the combustion chamber provided in the head of cylinder 1 and 10 is the cylinder longitudinal axis.

Suction duct 4 of cylinder 1 is then so constructed on cylinder inside ZS that, with respect to the upward movement of piston 2 in cylinder 1, it is subdivided into a pre-inlet part VE and a post-inlet part NE, as shown in FIGS. 3*a* ad 3*c*. The post-inlet part NE with a substantially rectangular cross-section is provided on the cylinder inside ZS with a generally V-shaped channel K running in the vicinity of the vertical median plane M, which can also be referred to as a piston deflection projection and which is bounded by the upper port boundaries 34*a*, 34*b* at right angles to cylinder longitudinal axis 10, the lower port boundaries 35*a*, 35*b* at right angles to the cylinder longitudinal axis 10 and the lateral port boundaries 36, 37 approximately parallel to cylinder longitudinal axis 10. The pre-inlet part following on at the bottom in the cylinder longitudinal direction and whose cross-section together with the cross-section of the post-inlet part on the cylinder inlet side is referred to as the suction port cross-sectional profile ES, has a cross-section in the form of a geometrical shape E and which is formed by an approximately V-shaped opening VO and the longitudinal slot 39 following on at the bottom in the cylinder longitudinal direction. Longitudinal slot 39 is so constructed through its ramp-like, bottom boundary surface 139 rising from the cylinder inside ZS to the mixed inflow side GE, that the cross-sectional surface formed by it is constructed so as to decrease to zero from the cylinder inside ZS to the mixed inflow side GE. The generally V-shaped opening cross-section VO on the cylinder inside ZS bounded by the port boundaries 38*a*, 38*b* which are at an angle to one another and to the cylinder longitudinal axis 10 is constructed so as to widen and flatten from the cylinder inside ZS to the mixed inflow side GE, so that on the latter the crescent-shaped cross-sectional profile VO' formed by the pitch circle-shaped boundary line 38*c* is constructed. The cross-sectional profile VO' supplements the substantially rectangular cross-section EG to give the total cross-section, the rectangular cross-section EG being bounded by the upper port boundary 30 at right angles to cylinder longitudinal axis 10 and the lower port boundary 31*a*, 31*b* at right angles to the cylinder longitudinal axis 10, as well as the lateral port boundaries 32, 33 approximately parallel to cylinder longitudinal axis 10.

The outlet duct 6 of cylinder 1 shown in FIGS. 4*a* to 4*c* is constructed on the silencer side exhaust gas outflow side AA with a substantially rectangular cross-section AG, which is bounded by the upper port boundaries 40*a*, 40*b* running at right angles to the cylinder longitudinal axis 10, the lower port boundary 41 running at right angles to the cylinder longitudinal axis 10 and the lateral port boundaries 42, 43 running approximately parallel to the cylinder longitudinal axis 10, it being widened in groove-like manner over and beyond the upper port boundary 40*a*, 40*b* on the exhaust gas outflow side AA, roughly in the vicinity of the horizontal median plane M. With respect to the downward movement of the piston, the suction duct 6 of cylinder 1 is so constructed on the cylinder inside ZS, that it is subdivided into a pre-outlet part VA and a post-outlet part NA, whose cross-sectional openings together form the outlet slot cross-sectional profile AS. The post-outlet part NA is constructed with an ellipsoidal cross-section, which is bounded by the pitch circle-shaped upper port boundaries 44*a*, 44*b* and the pitch circle-shaped lower port boundary 45, as well as the pitch circle-shaped lateral port boundaries 46, 47. The cross-section constructed as a geometrical shape GA in the vicinity of the pre-outlet part VA is constructed as a V-shaped opening cross-section VO bounded by the port boundary 48*a*, 48*b*, to which the longitudinal slot 49 is connected at the top parallel to the cylinder longitudinal axis 10. The longitudinal slot cover surface 49*a* bounding the longitudinal slot at the top and which extends from the cylinder inside ZS to the suction outflow side AA, is constructed so as to fall away in ramp-like manner from cylinder inside ZS to the exhaust gas outflow side AA. The V-shaped opening cross-section VO formed by the port boundaries 48*a*, 48*b* and extending from the cylinder inside ZS to the exhaust gas outflow side AA is constructed in such a way from the cylinder inside ZS to the exhaust gas outflow side that its cross-section reduces. The total cross-sectional profile of outlet duct 6 of cylinder 1 is based on the outlet cross-sectional profile and widens from the cylinder inside ZS to the exhaust gas outflow side AA in diffuser-like manner to a substantially rectangular cross-section AG on the silencer side exhaust gas outflow side AA.

In the case of the suction duct 4 of cylinder 1 shown in FIGS. 5*a* to 5*c*, compared with the embodiment of FIGS. 3*a* to 3*c*, the cross-section constructed as a geometrical shape E in the vicinity of the pre-inlet part VE is constructed as a rectangular cross-section RE bounded by the port boundaries 138*a*, 138*b*, 138*c*. The bottom boundary surface 238 of the rectangular cross-section RE is constructed so as to rise from the cylinder inside ZS to the mixture inflow side GE, the area 238*a* positioned adjacent to the cylinder inside ZS has a more pronounced slope with respect to the cylinder longitudinal axis 10 than the area 238*b* positioned adjacent to the mixture inflow side GE. The total flow cross-section of suction duct 4 starting from the inflow cross-section EG in this case is made constant in its horizontal extension from the mixture inflow side GE to the cylinder inside ZS, whilst only changing to a limited extent in its horizontal extension.

FIGS. 6*a* to 6*c* show another embodiment of the outlet duct 6 of cylinder 1 in which, compared with the embodiment of FIGS. 4*a* to 4*c*, the V-shaped opening cross-section VO, which is bounded by port boundaries 68*a*, 68*b*, has a constant cross-section from the cylinder inside ZS to the exhaust gas outflow side AA and the longitudinal slot 69 has a longitudinal slot cover surface 69*a* bounding it at the top and which comprises area 69*b*, 69*c* having a different slope relative to the cylinder longitudinal axis 10. The embodiment of the outlet duct 6 of cylinder 1 shown in FIGS. 7*a* to 7*c* differs from that according to FIGS. 6*a* to 6*c* by a larger V-shaped opening cross-section VO, because the port boundaries 78*a*, 78*b* bounding the latter have a larger angle to one another and to the cylinder longitudinal axis 10. The overall flow cross-section of outlet duct 6 of cylinder 1 in the embodiments of FIGS. 6*a* and 7*a* increases from the cylinder inside ZS to the exhaust gas outflow side AA, there being only a slight increase in the horizontal extension. The V-shaped cross-sectional enlargement formed in the embodiment according to FIGS. 4*a* to 4*c* in the transition area from the pre-outlet area VA to the post-outlet area NA and which only extends in the area of outlet channel 6 adjacent to the cylinder inside ZS and which decreases with respect to the cross-sectional surface of the cross-sectional enlargement VU, is missing in the embodiments according to FIGS. 6*a* to 6*c* and 7*a* to 7*c*, as well as in the embodiments according to FIGS. 10*a* to 10*c*.

In the embodiment of the outlet duct 6 of cylinder 1 shown in FIG. 8, the substantially ellipsoidal cross-section is laterally bounded by the straight, lateral port boundaries 86,87 in the vicinity of the post-outlet part NA, as compared with the embodiment according to FIGS. 4*a* to 4*c*.

The further embodiment of the outlet duct 6 of cylinder 1 shown in FIGS. 9*a* to 9*c* is constructed in the vicinity of the longitudinal slot 99 arranged in the pre-outlet part with a further rectangular longitudinal slot 199 connected at the top in the cylinder longitudinal direction to longitudinal slot 99. The longitudinal slot cover surface bounding longitudinal slot 199 and longitudinal slot 99 at the top has a more pronounced inclination to the cylinder longitudinal axis 10 in the area 99*b* towards the cylinder inside ZS than in the area 99*c* towards the exhaust gas of FIG. 9, the substantially ellipsoidal cross-section of the post-outlet part is once again bounded by straight, lateral port boundaries 96, 97.

The further embodiment of outlet duct 6 of cylinder 1 shown in FIGS. 10*a* to 10*c* is similar to that of FIGS. 6*a* to 6*c* but, in the vicinity of the pre-outlet part, the embodiment of FIGS. 10*a* to 10*c* has a longitudinal slot 109, whereof the cover surface bounding the latter at the top and which extends from the cylinder inside ZS to the exhaust gas outflow side AA initially drops away in ramplike manner when starting from the cylinder inside ZS and has a constant inclination in the further area adjacent to the outflow side AA. The further embodiment of outlet duct 6 of cylinder 1 shown in FIGS. 11*a* to 11*c*, compared with that of FIGS. 4*a* to 4*c*, is provided with a generally V-shaped cross-sectional enlargement VU, which has a different angle of inclination over its course and this angle can in fact change a number of times over the same. The overall cross-section of outlet channel 6 of cylinder 1 in the embodiment of FIGS. 11*a* to 11*c* is constructed in such a way that it increases in diffuser-like manner from the cylinder inside ZS to the exhaust gas outflow side AA, whereby the cross-section AG of outlet duct 6 approximately has 3 times the cross-sectional surface in the vicinity of the exhaust gas outflow side AA compared with that of the outlet port cross-sectional profile AS.

In the case of the embodiment of outlet port 6 of cylinder 1 shown in FIGS. 12*a* to 12*c* in the transition area from the pre-outlet area VA to the post-outlet area NA, there is a generally V-shaped cross-sectional enlargement VU in the cylinder longitudinal direction in the vicinity of the horizontal median plane M.

The embodiments according to FIGS. 13*a* to 13*c* and 14*a* to 14*c* are so constructed compared with that according to FIGS. 12*a* to 12*c* that the flow cross-section of outlet channel 6 of cylinder 1 increases in diffuser-like manner from cylinder inside ZS to the exhaust gas outflow side AA in such a way that the cross-section AG of outlet channel 6 in the vicinity of the exhaust gas outflow side AA has approximately 3 times the cross-sectional surface of the outflow slot cross-sectional profile AS. The difference between these embodiments relates to the different longitudinal dimensioning of the straight, lateral port boundaries 146, 147 in FIG. 14*c* compared with the straight, lateral port boundaries 166,167 of FIG. 14*b* bounding the post-outlet part with respect to its ellipsoidal cross-section.

The outlet duct 6 of cylinder 1 shown in FIGS. 15*a* to 15*c* is constructed on the silencer side exhaust gas outflow side AA with a substantially rectangular cross-section AG, which is bounded by the upper port boundaries 40*a*, 40*b* at right angles to the cylinder longitudinal axis 10, the lower port boundary 41 at right angles to the cylinder longitudinal axis 10 and the lateral port boundaries 42, 43 approximately parallel to the cylinder longitudinal axis 10. With respect to the downward movement of the piston, the suction duct 6 of cylinder 1 is so constructed on the cylinder inside ZS, that it is subdivided into a pre-outlet part VA and post-outlet part NA, whose cross-sectional openings together form the outlet port cross-sectional profile AS. The post-outlet part NA is constructed with an ellipsoidal cross-section, which is bounded by the pitch circle-shaped upper port boundaries 44*a*, 44*b*, the pitch circle-shaped lower port boundary 45 and the pitch circle-shaped lateral boundaries 46, 47. The cross-section constructed as a geometrical shape GA in the vicinity of pre-outlet part VA is constructed as a V-shaped opening cross-section VO bounded by the port boundaries 48*a*, 48*b* and to which is connected at the top and parallel to cylinder longitudinal axis 10 the longitudinal slot 49. The longitudinal slot cover surface 49*a*, which bounds the slot at the top and which extends from the cylinder inside ZS to the exhaust gas outflow side AA, is constructed so as to fall away in ramp-like manner from cylinder inside ZS to exhaust gas outflow side AA. The V-shaped opening cross-section formed by port boundaries 48*a*, 48*b* and which extends from the cylinder inside ZS to the exhaust gas outflow side AA, is so constructed from ZS to AA that its cross-section is reduced. The overall cross-sectional profile of outlet channel 6 of cylinder 1 is based on the outlet cross-sectional profile and widens from the cylinder inside ZS to the exhaust gas outflow side AA in diffuser-like manner to the substantially rectangular cross-section AG on the silencer side exhaust gas outflow side AA. In the transition area from the pre-outlet area VA to the post-outlet area NA in the vicinity of the horizontal median plane M in the longitudinal direction of the cylinder, there is a generally V-shaped, cross-sectional enlargement VU and which is larger than in the embodiment according to FIGS. 4*a* to 4*c*.

I claim:

1. In a high-speed, port-controlled, and fuel-mixture driven two-stroke internal combustion engine, having a certain speed range and employing crankcase scavenging, including at least one cylinder with an inside wall having a reciprocally movable piston operable therein, and defining a longitudinal axis, and at least one suction duct provided with a suction port, at least one outlet duct provided with an outlet port, and at least one scavenging duct provided with a transfer port, and wherein the inlet, outlet and transfer ports are located on the inside of the cylinder, the improvement comprising means for noise reduction of said engine over the entire speed range thereof, and including the combination of said suction and outlet ducts through which the fuel-mixture and the fuel-mixture-produced exhaust gas flow, respectively, wherein said suction duct of said cylinder operatively defines a substantially vertical median plane, and is formed with a substantially rectangular cross-section on a fuel-mixture inflow side thereof, having upper and lower port boundaries at right angles to the cylinder longitudinal axis, lateral port boundaries approximately parallel to the cylinder longitudinal axis, said suction duct having a cross-section extending below and beyond the lower port boundary in said vertical median plane, said suction port, which is gradually openable by movement of the piston, and having a cross-sectional profile on the inside wall of the cylinder, including a pre-inlet part, a post-inlet part adjoining an upper portion of said pre-inlet part along the longitudinal direction of the cylinder, said post-inlet part having a substantially rectangular cross-section and having a downwardly projecting and generally V-shaped channel in said vertical median plane, said substantially rectangular cross-section of said post-inlet part having upper and lower port boundaries at right angles to the cylinder longitudinal axis, and lateral port boundaries extending approximately parallel with the cylinder longitudinal axis, and a suction duct cross-sectional profile extending from said fuel-mixture inflow side along a flow direction of the fuel mixture to said cylinder inside wall, having a generally V-shaped channel terminating in said pre-inlet part, extending downwardly from said inflow side towards said inside wall in the region of the vertical median plane, and uniformly varying vertically along said flow direction, wherein said outlet duct of the cylinder is formed with a substantially rectangular cross-section on an exhaust gas outflow side thereof, and having upper and lower port boundaries at right angles to the cylinder longitudinal axis, and lateral port boundaries extending approximately parallel to the cylinder longitudinal axis, said cross-section of said outlet duct extending above and beyond said upper port boundary substantially near said vertical median plane, and said outlet port, which is gradually openable by movement of the piston, and having a cross-sectional profile on the inside of said cylinder, including a pre-outlet part, and a post-outlet part adjoining said pre-outlet part along the cylinder longitudinal axis on a lower side thereof, and said post-outlet part having a substantially elliptical shape with arcuately shaped lower and upper port boundaries, an outlet duct cross-sectional profile extending from the cylinder inside wall in a direction of the exhaust gas flow, having a generally V-shaped channel originating in said pre-outlet part extending downwardly from said inside wall toward said other outflow side, and varying uniformly along a vertical direction thereof, wherein due to the gradual opening of said suction and outlet ports noise normally generated by flow of said fuel mixture and of said exhaust gas in said engine is reduced.

2. High-speed, port-controlled, two-stroke internal combustion engine according to claim 1, wherein said cross-sectional profile extending from the fuel mixture inflow side remains constant along an operatively horizontal extension thereof.

3. High-speed, port-controlled, two-stroke internal combustion engine according to claim 1, wherein said cross-sectional profile extending from the fuel mixture inflow side decreases uniformly along an operatively horizontal extension thereof.

4. High-speed, port-controlled, two-stroke internal combustion engine according to claim 1, wherein said outlet port cross-sectional profile on the inside of said cylinder defines arcuate lateral port boundaries.

5. High-speed, port-controlled, two-stroke internal combustion engine according to claim 1, wherein said outlet port cross-sectional profile on the inside of said cylinder defines straight lateral port boundaries.

6. High-speed, port-controlled, two-stroke internal combustion engine according to claim 1, wherein said outlet cross-sectional profile extending from the outlet cross-section in a direction of the exhaust gas remains constant in a horizontal extension thereof.

7. High-speed, port-controlled, two-stroke internal combustion engine according to claim 1, wherein said outlet cross-sectional profile extending from the outlet cross-section in a direction of the exhaust gas decreases uniformly in a horizontal extension thereof.

8. High-speed, port-controlled, two-stroke internal combustion engine according to claim 1, wherein the suction duct of said cylinder has a cross-section in the form of a geometrical shape in a vicinity of the pre-inlet part, which is formed as a substantially rectangular cross-section with its lower port boundary extending at right angles to the cylinder longitudinal axis, and having lateral port boundaries extending approximately parallel to the cylinder longitudinal axis.

9. High-speed, port-controlled, two-stroke internal combustion engine according to claim 8, wherein a bottom boundary surface of the rectangular cross-section is formed so as to rise from the cylinder inside to the fuel mixture inflow side, an area adjacent to the cylinder inside having a more pronounced slope with respect to the cylinder longitudinal axis than another area disposed in the fuel mixture inflow side.

10. High-speed, port-controlled, two-stroke internal combustion engine according to claim 1, wherein the outlet duct of the cylinder has a cross-section in the form of a longitudinal slot communicating with the post-outlet part upwardly thereof along the cylinder longitudinal direction, and extending parallel to the cylinder longitudinal axis.

11. High-speed, port-controlled, two-stroke internal combustion engine according to claim 10, wherein said longitudinal slot communicates with a rectangular longitudinal slit upwardly thereof, said longitudinal slit extending along the cylinder longitudinal direction, and parallel to the cylinder longitudinal axis.

12. High-speed, port-controlled, two-stroke internal combustion engine according to claim 1, wherein the suction duct of said cylinder has a cross-section formed as a geometrical shape in a vicinity of said pre-inlet part, said pre-inlet part being formed by a generally V-shaped cross-sectional opening bounded by additional port boundaries having an angle to one another, and to the cylinder longitudinal axis.

13. High-speed, port-controlled, two-stroke internal combustion engine according to claim 12, wherein on the V-shaped cross-sectional opening there is formed a longitudinal slot extending downwardly along the cylinder longitudinal direction and arranged parallel to the cylinder longitudinal axis.

14. High-speed, port-controlled, two-stroke internal combustion engine according to claim 13, wherein a longitudinal slot base surface bounding the longitudinal slot at a bottom thereof is formed so as to rise in a ramp-like manner from the cylinder inside to the cylinder outside.

15. High-speed, port-controlled, two-stroke internal combustion engine according to claim 1, wherein the outlet duct of said cylinder has a cross-section formed as a geometrical shape near said pre-outlet part in the shape of a generally V-shaped cross-section opening bounded by additional port boundaries which are at an angle to one another, and to the cylinder longitudinal axis.

16. High-speed, port-controlled, two-stroke internal combustion engine according to claim 15, wherein the V-shaped cross-sectional opening communicates with a longitudinal slot formed upwardly thereof along the cylinder longitudinal direction and extending parallel to the cylinder longitudinal axis.

17. High-speed, port-controlled, two-stroke, internal combustion engine according to claim 15, wherein a longitudinal slot cover surface bounds said longitudinal slot upwardly thereof, said slot cover surface extending along an interior periphery of the cylinder to an exhaust gas outflow side thereof, and has a more pronounced slope with respect to the cylinder longitudinal axis in an area facing towards the interior of the cylinder, than in another area facing an outflow side of the fuel mixture.

18. High-speed, port-controlled, two-stroke internal combustion engine according to claim 17, wherein said longitudinal slot cover surface bounding the longitudinal slot upwardly thereof, and which extends along the interior periphery of the cylinder to the exhaust gas outflow side, falls away in ramp-like manner along said interior periphery of the cylinder to the exhaust gas outflow side.

19. High-speed, port-controlled, two-stroke internal combustion engine according to claim 17, wherein said outlet duct of said cylinder has a generally V-shaped cross-sectional enlar-largement extending along the cylinder longitudinal direction near the horizontal median plane in a transition area from the pre-outlet part to the post-outlet part, said cross-sectional enlargement extending in a region of the outlet duct along the interior periphery of the cylinder, but decreasing from the interior of the cylinder to the exhaust gas outflow side.

20. High-speed, port-controlled, two-stroke internal combustion engine according to claim 17, wherein said outlet duct of said cylinder defines a fuel flow cross-sectional area which increases divergingly from the cylinder inside to the exhaust gas outflow side, so that the cross-section of the outlet duct of the cylinder near the exhaust gas outflow side has approximately twice the cross-sectional area than the cross-sectional profile of said outlet port.

21. High-speed, port-controlled, two-stroke internal combustion engine according to claim 17, wherein said outlet duct of said cylinder defines a fuel flow cross-sectional area which increases divergingly from the cylinder inside to the exhaust gas outflow side, so that the cross-section of the outlet duct of the cylinder near the exhaust gas outflow side has approximately three times the cross-sectional area than the cross-sectional profile of said outlet port.

* * * * *